US011738247B2

(12) United States Patent
Chorne

(10) Patent No.: US 11,738,247 B2
(45) Date of Patent: Aug. 29, 2023

(54) GOLF BAG CARRIER WITH GOLF BAG AND BASE HAVING DETACHABLE WHEELS

(71) Applicant: Robert Chorne, Freeport, NY (US)

(72) Inventor: Robert Chorne, Freeport, NY (US)

( * ) Notice: Subject to any disclaimer, the term of this patent is extended or adjusted under 35 U.S.C. 154(b) by 100 days.

(21) Appl. No.: 17/235,568

(22) Filed: Apr. 20, 2021

(65) Prior Publication Data

US 2021/0322840 A1 Oct. 21, 2021

Related U.S. Application Data

(60) Provisional application No. 63/101,248, filed on Apr. 21, 2020.

(51) Int. Cl.
*A63B 55/60* (2015.01)
*A63B 55/30* (2015.01)
*A63B 55/57* (2015.01)

(52) U.S. Cl.
CPC ..... *A63B 55/60* (2015.10); *A63B 55/30* (2015.10); *A63B 55/57* (2015.10)

(58) Field of Classification Search
CPC ..... A63B 55/60; A63B 55/30; A63B 55/57
See application file for complete search history.

(56) References Cited

U.S. PATENT DOCUMENTS 2,590,178 A * 3/1952 Jamison ..... A63B 55/60 280/DIG. 6
2,629,609 A * 2/1953 Wilson ..... A63B 55/57 280/DIG. 6
4,017,091 A * 4/1977 Wallen ..... A63B 55/60 280/DIG. 6
4,629,202 A * 12/1986 Nelson ..... A63B 55/60 280/DIG. 6
4,836,565 A * 6/1989 Catalo ..... A63B 55/00 280/DIG. 6
5,112,068 A * 5/1992 Liao ..... A63B 55/60 280/DIG. 6
6,168,123 B1 * 1/2001 Stein ..... A63B 55/53 248/167

(Continued)

FOREIGN PATENT DOCUMENTS

DE 102009001696 A1 * 9/2010 ..... A63B 55/53
DE 202013104517 U1 * 12/2013 ..... A63B 55/00
FR 2989899 A1 * 11/2013 ..... A63B 55/50

*Primary Examiner* — Steve Clemmons
(74) *Attorney, Agent, or Firm* — John F. Vodopia

(57) ABSTRACT

A golf bag carrier has a base with opposing upper and lower base surfaces, an outer base wall between the upper and lower base surfaces and right and left arm assemblies attached to or extending from the outer base wall. The carrier also has a golf bag with an open top end, and a bottom end arranged opposite the top end that is attached to or integral with the base, and first and second wheels detachably connectable to the right and left arm assemblies, respectively. The base is virtually separated into two substantially equally sized opposing first and second base portions. The right and left arm assemblies are arranged in the first opposing base portion. A stand device deployment mechanism is arranged in the second opposing base portion, substantially opposite the arm assemblies, which are adapted to enable the first and second wheels to be detachably removed from the golf bag carrier to facilitate storage.

19 Claims, 9 Drawing Sheets

(56) References Cited

U.S. PATENT DOCUMENTS

| | | | | |
|---|---|---|---|---|
| 6,231,059 | B1 * | 5/2001 | Cheldin | A63B 55/53 280/47.24 |
| 6,460,867 | B2 * | 10/2002 | Sciulli | A63B 55/57 280/DIG. 6 |
| 6,561,527 | B2 * | 5/2003 | Spadino | B62B 1/042 280/43.16 |
| 6,672,600 | B2 * | 1/2004 | Engelhardt | A63B 55/57 280/DIG. 6 |
| 7,114,730 | B2 * | 10/2006 | Cheldin | A63B 55/57 280/DIG. 6 |
| 7,584,972 | B2 * | 9/2009 | Myers | A45C 13/262 280/47.131 |
| 9,895,586 | B2 * | 2/2018 | Hecht | A63B 55/40 |
| 2002/0014753 | A1 * | 2/2002 | Cheng | A63B 55/60 224/153 |
| 2004/0035728 | A1 * | 2/2004 | Ortega | A63B 55/30 280/DIG. 6 |
| 2005/0284781 | A1 * | 12/2005 | Te-Pin | A63B 55/57 206/315.7 |

* cited by examiner

GOLF BAG CARRIER WITH GOLF BAG AND BASE HAVING DETACHABLE WHEELS

CROSS-REFERENCE TO RELATED APPLICATIONS

This application derives the benefit of the filing date of U.S. Provisional Patent Application No. 63/101,248, filed Apr. 21, 2020. The contents of the provisional application are incorporated by reference in this application.

BACKGROUND OF THE INVENTION

This invention relates to a golf bag carrier comprising a base and golf bag, the base formed with detachable wheels, or detachable wheel assemblies. The golf bag preferably is fixedly attached to, or integral with the base, where the wheels or wheel assemblies are detachably attached to the base. The base is constructed to be relatively light weight. With the detachable wheels, or wheel assemblies attached, the golf bag carrier and bag may be wheeled to a destination, where the detachable wheels or wheel assemblies may be detached. With or without the wheels, the base and golf bag may be readily carried by a user, or more conveniently stored or more stably seated on a ground surface without the wheels. For that matter, the bag may be easily carried with the wheels on, according to need. The inventive golf bag carrier essentially is a "carry" golf bag with detachable wheels. For that matter, the base is constructed so that with the wheels attached or detached, the center of gravity or mass of the golf bag carrier is relatively low and close to the ground and has a high moment of inertia, so that the inventive carrier is particularly stable with the wheels attached. The golf bag construction includes a handle that is deployed to enable the golf bag carrier to be pushed and pulled while the golf bag maintains is shape and integrity as a container.

Golf bags are well known. Golf bags are used to carry golf clubs and accessories, such as balls and tees, in playing a game of golf. Golfers can either carry the golf bag over their shoulder, place the golf bag on a riding golf cart or place the golf bag on a separate device known as a pull cart by the golfer can pull the golf bag along the ground while walking around a golf course or a push cart where people can push the bag along the ground while walking on the golf course. Many golfers prefer walking to obtain appropriate exercise and, therefore, choose not to use the riding golf cart. However, when a golfer carries his clubs, the weight of the clubs and bag can often cause soreness and hurt the golfer's shoulders as well as change the performance in the game. Therefore, many golfers choose to use a pull cart or a push cart.

In this case, the golfer sometimes encounters separation of the bag from the separate cart, as there is a bag that needs to be placed on a separate cart and secured by strapping, etc. which often loosens, or the bag shifts which changes the balance and center of mass which can cause tipping over. This and other movements cause problems and time wasted to get the golf bag and contents things back in order on the cart. And many golfers find that using a pull or push cart is cumbersome, because, in many cases, the pull cart must be folded and unfolded, and takes additional space for storage in the car and at home and on the course the golfer has to walk longer distances than one who carries a bag as one finishes putting out, the ones who carry walk across. the green vs the ones who push or pull need to walk around the green.

Other known constructions that are used to wheel golf bags combine a golf cart with a base with wheels and frame construction, comprising a lower base portion into which the bag is secured. These typically are bulky additions to the normal base, at the base region due to the additional materials required. For that matter, golf bags secured to a separate conventional lower base with frame attached construction, like those golf bags secured to an additional cart can break, rendering such golf bag and separate cart, or cart with the attached base, unusable for walking the course due to a broken base, frame or parts, or are otherwise inefficient with additional weight; wheels that lack performance become useless, limiting value of any golf bag attached thereto.

U.S. Pat. No. 5,112,068 ("the '068 patent") discloses a T-shape mechanism at the very bottom of the base of a golf can, at the base inner and outer surfaces. This golf cart of the '068 patent, however, due to the shape, size and location, make it ill-suited for rolling, and for transporting long distances: such a cart also is ill-suited for pushing the bag over the course as many people like to do. Likewise, the cart of the '068 patent is ill-suited to stand automatically and when stored, its space requirement for storage is excessive in view of the bulk volume for the pocket storage portion.

U.S. Pat. No. 4,836,565 ("the '565 patent") discloses a rectangularly-shaped suitcase-like container for holding golf clubs which may be converted into a golf cart. The device consists of a rectangular case resembling a suitcase, a pair of detachable wheels, and a detachable handle. The wheels and the handle may be stored in pockets provided on the external side of the lower face of the suitcase or may be stored in a separate bag of small dimensions. The golf cart disclosed by the '565 patent, however, due to the rectangular shape and size of the suitcase-like container, make it ill-suited for attachment to the back of a riding golf can and carrying over a golfer's shoulder.

U.S. Pat. No. 4,629,202 ("the '202 patent") shows a combination golf cart and golf bag that consists of a rectangularly-shaped body, a pair of detachable wheels, and a detachable handle. A review of the drawing figures, however, highlights that golf clubs are unlikely to be easily accessible for deployment with the wheels in the storage position; the size and shape of the golf club container have questionable utility for attaching the device to a riding golf cart and carrying over a golfer's shoulder, where necessary, for example, when a goiter wishes to carry his/her golf bag onto or over the green.

U.S. Pat. No. 4,017,091 ("The '091 patent") discloses a convertible golf cart, which consists of a rectangular body, a pair of detachable wheels, a resting arm, and a telescoping pull handle. However, the container's size and shape make it ill-suited for attaching the device to a riding golf can and separating to carry over a golfer's shoulder.

U.S. Pat. No. 2,590,178 ("the '178 patent") discloses the use of a convertible golf bag and cart consisting of a rectangular body, a pair of detachable wheels that can be stored therein, and a detachable handle. The storage space required for the detachable wheels for this device, however, dictate that it has a limited capacity to receive clubs and/or its size would be problematic for detachment to transfer a riding golf cart, or detachment for carrying over a golfer's shoulder.

These and like prior art do not teach or suggest a golf bag and base with detachable wheels construction that can easily be pushed or pulled on the golf course, over long and short distances and carry the bag across the green or other distances while the wheels are attached.

SUMMARY OF THE INVENTION

The present invention was developed in an effort to realize a golf bag carrier with a golf bag and base combination, that can be pushed, palled or carried, the base including detachable wheels or wheel assemblies that overcomes the shortcomings of the prior art.

In an embodiment, the invention presents a golf bag carrier constructed with a golf bag attached to a base, the base formed with wheel assemblies that enable the wheels to be detached from the base. Alternatively, the wheel assemblies may include the wheels, and the wheels and respective wheel assemblies are detachable from the base.

The inventive golf bag carrier with golf bag and attached or integral base with detachable wheels, or detachable wheel assemblies allows a user to detach the wheels or wheel assemblies from the base, such that the golf bag and base with or without the wheels is easy to carry, easy to store and relatively more stable when set in place on a surface, due to a low center of/gravity, higher moment of inertia with or without the wheels/wheel assemblies removed.

A handle, adapted to be maintained in the golf bag until deployed, and a construction of the golf bag to enable the wheeled golf bag carrier (with the wheels attached) to be pushed and pulled at the handle without collapsing any portion of the golf bag, i.e., the golf bag maintains is shape and integrity as a container, even when pushed and/or pulled at the handle, and/or carried, e.g., such as across the green. For that matter, the preferred construction of the base and detachable wheels, or detachable wheel assemblies provides the golf bag carrier with golf bag and attached or integral base with detachable wheels, or detachable wheel assemblies, with a stability attributed to a higher moment of inertia and very low center of gravity in motion or in a stationary position, i.e., a wheeled destination, for example, on a golf course, allowing for golf bag contents to be readily accessed.

With the wheels or wheel assemblies attached or detached, the golf bag carrier may be carried on one's shoulder or shoulders on or off the golf course or positioned in a traditional "riding" golf cart, with or without the wheels/wheel assemblies. The golf carrier part of the inventive golf bag carrier with golf bag and attached or integral base with detachable wheels, or detachable wheel assemblies is constructed front high-strength, light-weight materials to be light and compact, and reliable on and off the golf coarse to a position w here the base golf bag combination can be stably seated to avoid tipping and spilling the golf bag contents, with or without the wheels attached, and carried whether the wheels are attached, or detached.

The golf bag pan of the inventive golf bag carrier with golf bag and attached or integral base with detachable wheels, or detachable wheel assemblies, is constructed to maintain its conventional shape w when pushed or pulled, when the inner volume of the golf bag has minimal contents or contains golf clubs and accessories. The golf bag preferably is open at its top end, opposite its base end, which is attached to or integral with the base. The open top end facilitates insertion of golf clubs; shoulder straps preferably are attached to the bag, but of course may alternatively be attachable to the golf bag, and stored in the bag, were convenient. The shoulder straps are deployed for carrying the golf bag and base over a golfer's shoulder or shoulders. The golf bag preferably also has a pocket with a telescopic handle that allows the golf bag carrier with golf bag and attached or integral base with detachable wheels, or detachable wheel assemblies to be readily pulled or pushed or carried.

The base has a receiving portion connected or integral with a bottom region of the golf bag, which golf bag preferably is constructed with rods or stays 159 extending from the receiving portion. The base also is adapted with wheel assemblies that comprise a quick connect portion configured to receive and secure an axle of a detachable wheel. Alternatively, the wheel assemblies may include the wheels and an axle that is detachably connected to the base, where the base includes an axle to which the wheel assemblies and wheels attach. With the wheels, or wheel assemblies attached or detached from the base, the golf bag and base are readily grasped and carried, stored and positioned stably on a floor or ground surface.

The rods or stays 159 preferably are deployed on each opposing side of a line separating the base ("base separation line"), and base upper surface in half, forming two opposing base sub-sections, somewhat hemispherical shaped, but also with difference; the base separation line is substantially in parallel with a line separating the wheels. However, the rods and stays are not limited to that position, but are deployed where necessary to assure the structural integrity of the tubular-like bag portion. In a first base subsection of the opposing base subsections, is the wheel assemblies and wheels, extending between the line separating the wheels that is in substantially parallel with the base separation line.

The opposing or second base subsection is adapted with a stand device deployment mechanism, that extends away from first base section. The stand device deployment mechanism and an edge of the base, or a skirt-like portion of the base extending from the base edge. And the stand device deployment mechanism deployed against the ground, the stand device and its stand rods deploy for stable three-point contact (assuming that the stand device deployment mechanism and base portion are pressed against the ground as one of the three contact points). Preferably, where the stand device deployment mechanism, and consequently the stand rods deploy, the respective wheels are not in contact with the ground.

The arm assemblies embody a lower horizontal arm section, integral or attached to and extending substantially horizontally away from at outer perimeter of the base to a transition arm section. The transition arm section is attached to or integral with, and extends substantially vertically, or substantially diagonally vertically, away from, an outer extent of the low er horizontal arm section. An upper substantially horizontal arm section is attached to or integral with, and extends substantially horizontally away from an outer extent of the transition arm section. Preferably, the lower horizontal arm section extends from a portion of the base perimeter closest to the bottom end, and therefore, the ground surface. Then regardless of the diameter of the wheels connected at the quick connect receiving hole on the arm section, the higher moment of inertia and lowest center of gravity with optimal stability is realized when moving and stationary.

The wheels detachably connect to the am assemblies, preferably at a quick connect mechanism included in the second horizontal arm section. An axle of a wheel with axle would slide into and attach to the quick connect mechanism, for attachment to the base, and when actuated, disconnect the axle, and the wheel. Alternatively, the wheel assembly, or some part of the wheel assembly, including the quick-connect mechanism, is permanently connected to the wheel and axle, where that combination connects to the base.

The upper horizontal arm sections preferably include an upper surface upon which, or through which an actuation button is arranged. The actuation button, which upon application of a depressing force, releases a spring force that, without the depressing force, compels a clamp to grasp and hold fast an axle of a wheel presently inserted into an opening in an attachment side of the upper horizontal arm sections, or release an axle of a wheel to be detached from the upper horizontal arm section. That is, the axle is inserted as pressure is applied, and pressure is asserted to facilitate a loosening of a grip on an axle, when the wheel connected thereto is to be detached. The detachable wheels, or detachable wheel assemblies, when detached, may be stowed in the golf bag, or a pocket formed on an outer surface of the golf bag or any suitable place like a basket on a motorized golf cart.

Preferably, the golf bag of the inventive golf bag carrier with golf bag and attached or integral base with detachable wheels, or detachable wheel assemblies, is fabricated to be tubular shaped (rectangular or cylindrical) from synthetic or natural material, that is, any suitable material or combination of materials. The tubular shaped (rectangular or cylindrical) golf bag construction may be sewn, molded, glued, riveted, fastened, using any corresponding respective methods of manufacture. For that matter, the tubular shaped (rectangular or cylindrical) golf bag can have a pocket or multiple pockets, inside an inner bag volume, or arranged on an outer perimeter surface or any surface of the golf bag. Inside pockets, for example, may be configured as separators for maintaining clubs in separate positions. The separators can be made of any suitable material or combination of suitable materials. The separators can be full length or partial length. There can be any number of separators desired. The separators can be fixed by sewing, gluing, molding or by other manufacturing methods understood by those of skill in the art. sewn or not sewn.

The pockets can have zippers, hook and loop portions, netting, smooth surface materials, or any combination to house goods and open and close the pockets and house the products internally in the pockets such as keys, wallet, phone, tees and the like for golf articles. The golf bag also may have a hook, loop or other means to hold a towel, scorecard and the like. The pockets can be lined or unlined or any combination of suitable materials, natural or synthetic or any combination of natural and synthetic. The golf bag also can have an umbrella holder or well or any suitable way to hold the umbrella on or within a portion of the bag, manufactured in sections and assembled in one or more places. The bag can have hook and loop on outside to receive other articles like a golf glove or other articles. The rods or stays 159, that keep the tubular shaped (rectangular or cylindrical) section taut, can be removed and allow the bag portions to collapse for shipping and/or storage purposes.

The deployable handle can be fixed to a lop portion or any suitable portion of the tubular shaped (rectangular or cylindrical) bag portion of the inventive golf bag carrier with golf bag and attached or integral base with detachable wheels, or detachable wheel assemblies, or a region near the top of the bag portion, along the side of the bag portion or any suitable position, as long as it extends up to position that would optimize pushing or pulling the handle. The handle can be telescopic or fixed and may be fixed permanently on the bag or adapted to be removable. The telescopic handle most preferably is secured to the golf bag and contained within a pocket attached to or integral with the golf bag, preferably an outer pocket; the telescopic handle is deployed by opening the pocket and extending the handle for use. When the golfer doesn't need to push or pull, they can depress the telescopic handle mechanism into the pocket assembly.

The wheels can be smooth or have treads, inflatable, solid or hollow and formed of any suitable material such as rubber, synthetic rubber, polymer, natural material or materials, synthetic materials or any combination of materials. The wheels can be molded, injection molded, extruded or any suitable manufacturing method or methods. The wheels can be any suitable size, for example, with an 8 inch diameter.

In an alternative embodiment, the arm assemblies may embody a disc- or plate-like attachment assembly, that is attached to an outer perimeter wall of the base, with the female or male portion, that allows an axle and attached wheel to attach to the disc- or plate-like attachment assembly. The disc- or plate-like attachment assembly includes an attachment mechanism, such as a quick-connect mechanism. The capability of detachably attaching the wheels or wheel assemblies to the base of the golf bag carrier with golf bag and attached or integral base with detachable wheels, or detachable wheel assemblies, eliminates problems associated with traditional golf carts, such as those discussed above. If the inventive golf bag carrier with golf bag and attached or integral base with detachable wheels, or detachable wheel assemblies, will be used on a riding cart, one car easily "pop off" the wheel, or wheel assembly, and allows replacement wheels (for example, in case other wheel types are desired to be used if certain wheel wear out, go flat, are too large in width and/or diameter, or are too small in width and/or diameter, so the inventive golf bag carrier with golf bag and attached or integral base with detachable wheels, or detachable wheel assemblies can still function.

While the base of the inventive golf bag carrier with golf bag and attached or integral base with detachable wheels, or detachable wheel assemblies preferably is formed with a stand device deployment mechanism, an alternative embodiment includes a third wheel at the location at which the stand device deployment mechanism would normally be attached to or integrally formed with and extend from the outer perimeter of the base. An alternative embodiment can have a tube construction to maintain the integrity of the bag's shape.

A size of the top opening (sometimes referred as "the bag size") is in a range of 6"-12," preferably 8.5"-10.5" and most preferably 9.5" inches. The wheel sizes are within a range of 4"-15," preferably in a range of 8-12" (diameter) and most preferably 8". The size of the axle is in a range of ½-30" range, preferably in a 1"-12" range and most preferably in a range of 3.5-4". In one embodiment, the size of each axle is 3 and ⅝ inches (i.e., 3.625"). The axle can be for one wheel or multiple wheels. The axle hub on the tag can be from 1-8, preferably 1-3 inches and 1.25" inches in the preferred embodiment.

In an alternative embodiment, the inventive golf bag carrier, wherein the first and second arm assemblies include first and second axles upon which the first and second wheels are detachably attached, and wherein the first and second wheels include mechanisms for receiving, grasping and holding fast the first and second axles of the first and second arm assemblies to the first and second wheels, effecting attachment, and for releasing the first and second axles of the first and second arm assemblies, from the first and second wheels, effecting detachment.

BRIEF DESCRIPTION OP THE DRAWINGS

The invention will be described in conjunction with the following drawings in which like reference numerals designate like elements and wherein.

DETAILED DESCRIPTION OF THE INVENTION

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

FIGS. 1-8 present embodiment of the inventive golf bag carrier with golf bag and attached or integral base with detachable wheels, or detachable wheel assemblies, the golf bag supported by rods or stays 159 to maintain its traditional rectangular- or cylindrical-tubular shape when pushed, pulled or arranged in a fixed position, for example, proximate a green on a golf course.

Figure 3:
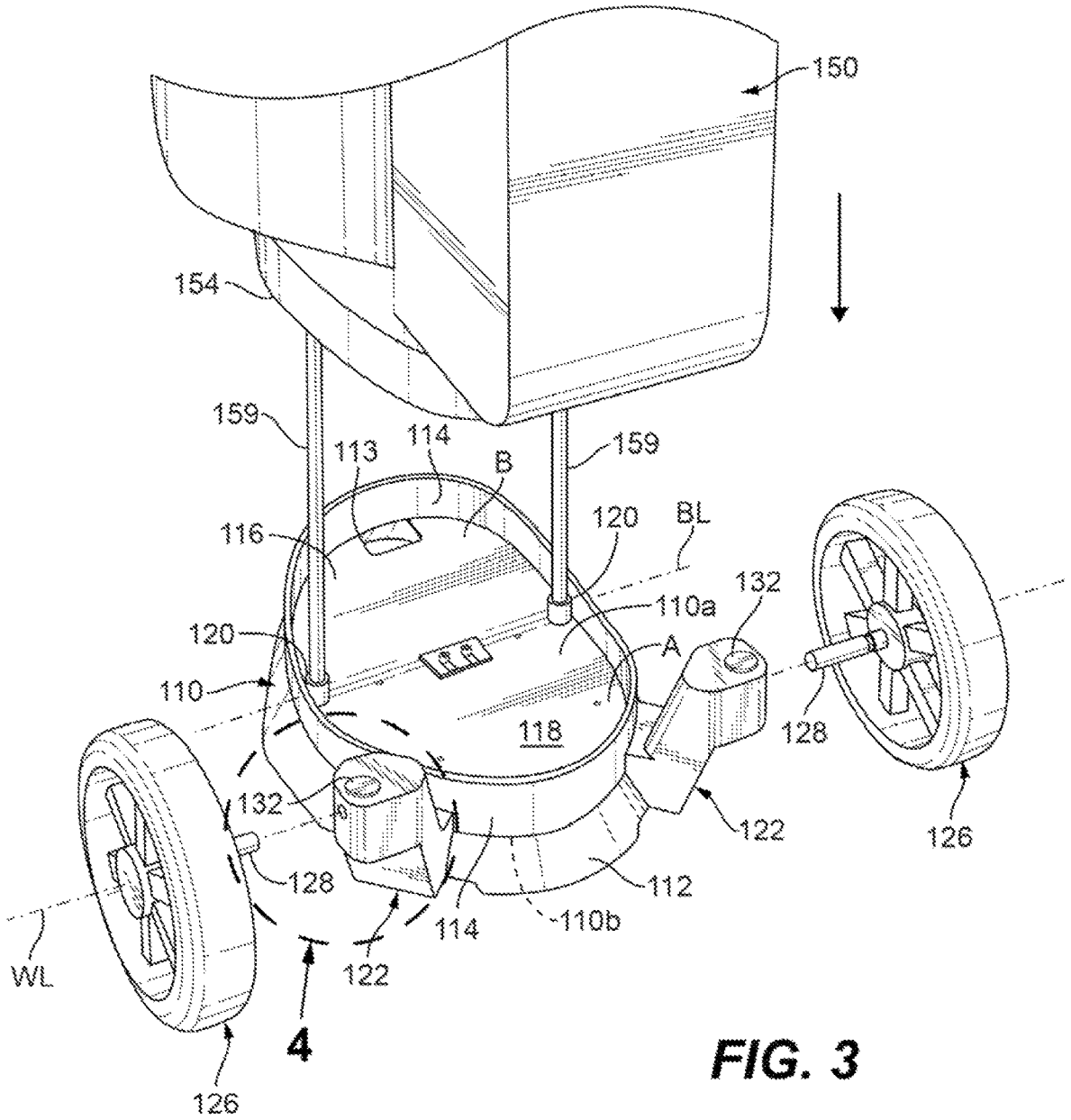
FIG. 3 is an exploded view of the wheeled golf bag carrier, as depicted in FIG. 1, highlighting the base with detachable wheels.

As shown, golf bag carrier 100 includes a substantially planar base 110, with an upper (see FIGS. base surface 110*a* and an opposing lower base surface 110*b*, and upper 114 and lower 112 outer base wall, and right and left arm assemblies 122 attached to or extending from the upper and or lower outer base walls, or connected to and extending from an edge or other surface or area of the substantially planar portion of the base, between the upper and lower base surfaces. The inventive golf bag carrier includes a golf bag 150 with an open top end, and a bottom end 154 arranged opposite the top end that is attached to or integral with the base 110. first and second wheels 126 detachably connectable to the right and left arm assemblies 122, respectively. Preferably, the substantially planar base 110 is virtually separated into two substantially equally-sized base portions, i.e., into a first base portion A and a second base portion B, the line of virtual separation represented by dashed line BL as shown in FIG. 3.

Figure 1:
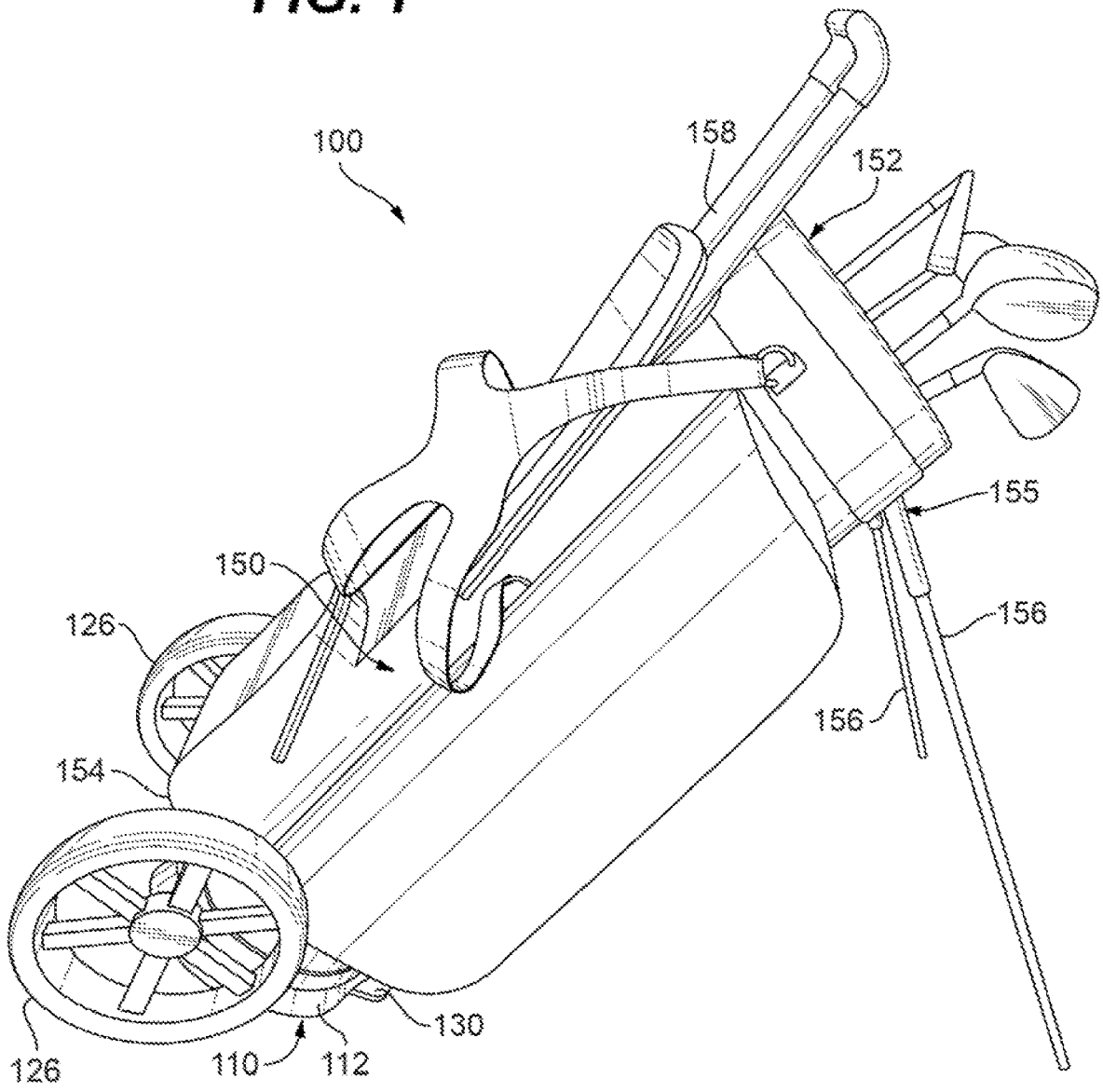
FIG. 1 is a side perspective view of an embodiment of the golf bag carrier with golf bag and base with detachable wheels, the golf bag supported by a stand device, which is deployed by a stand device deployment mechanism and the telescopic handle is partially extended from the pocket.
Figure 2:
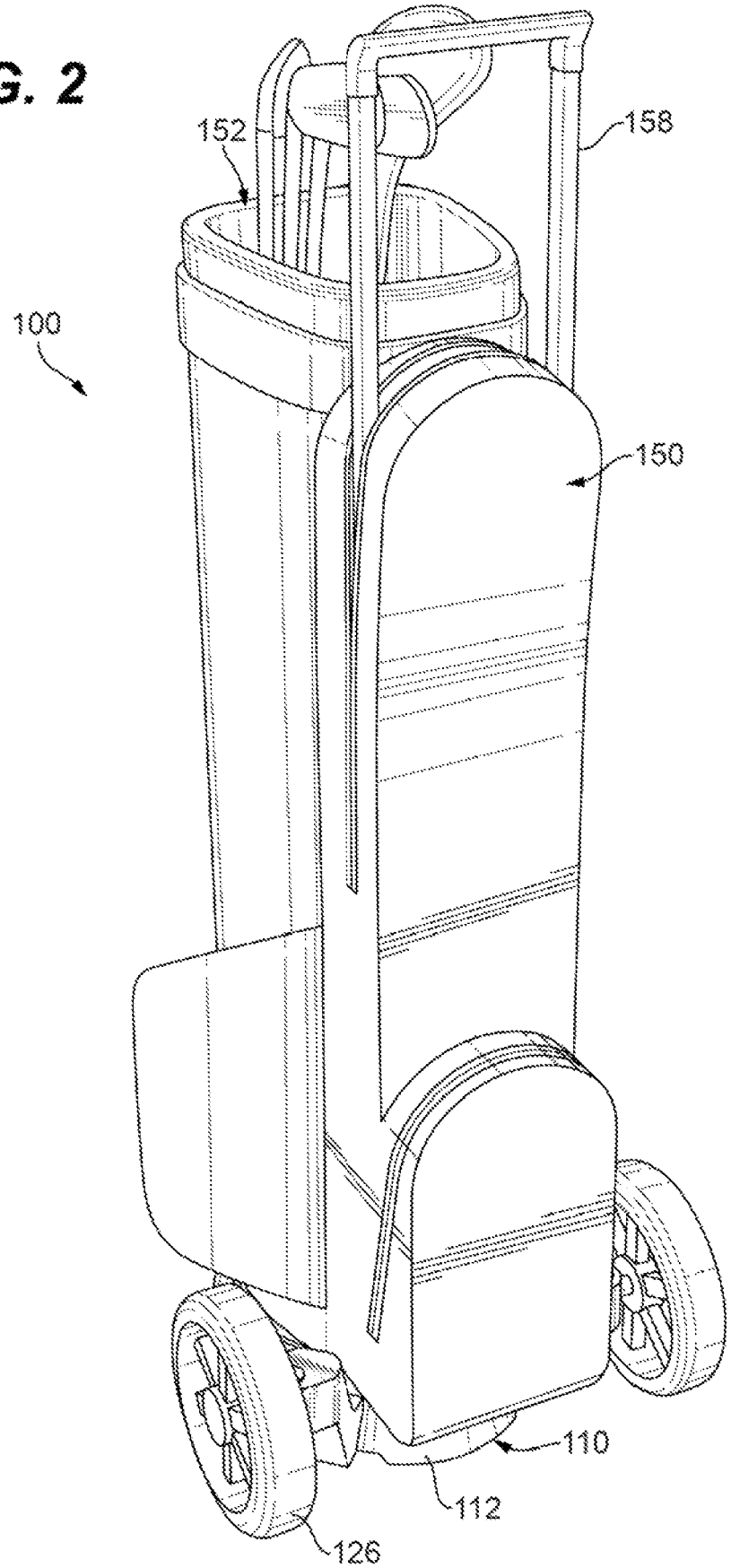
FIG. 2 is a rear perspective view of the golf bag carrier, as depicted in FIG. 1.
Figure 6:
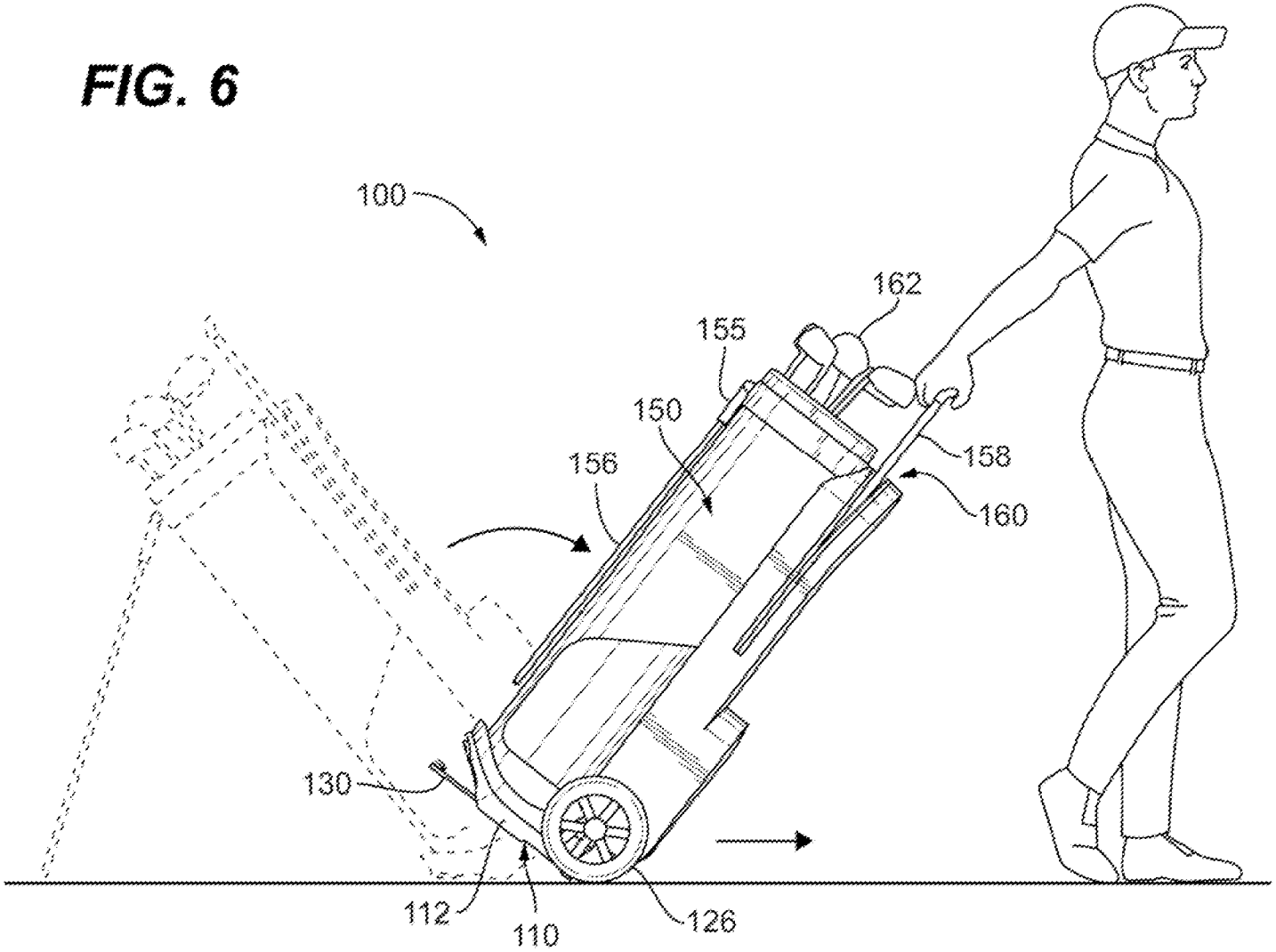
FIG. 6 is a side view of the golf bag carrier, as depicted in FIG. 1, being pulled by a user.
Figure 7:
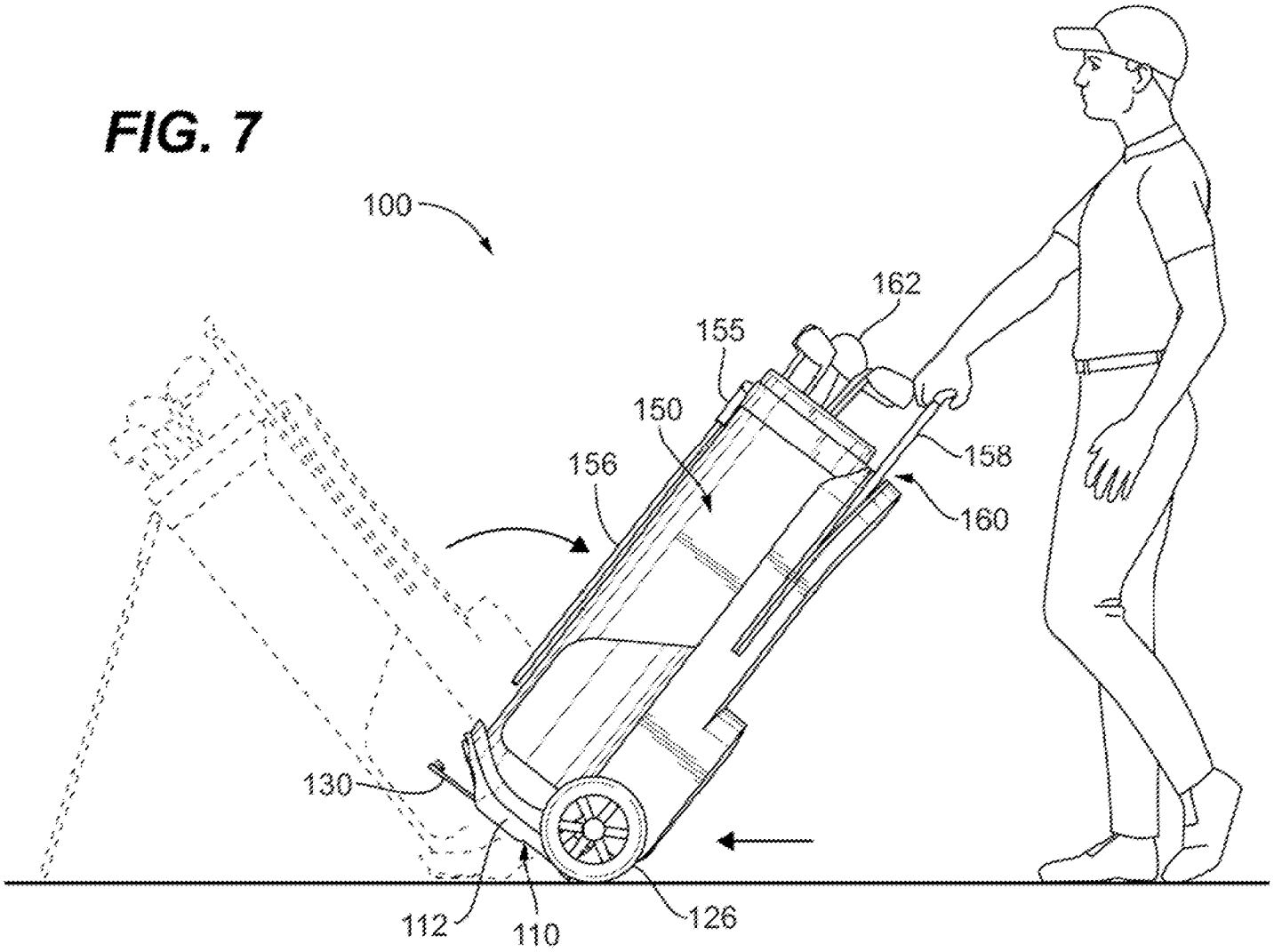
FIG. 7 is a side view of the golf bag carrier, as depicted in FIG. 1, being pushed by a user.

The right and left arm assemblies 122 art arranged in the first opposing base portion A, A stand device deployment mechanism 130 is arranged in the second opposing base portion B, which stand device deployment mechanism 130 is substantially opposite the arm assemblies. The stand device deployment mechanism is pan of a stand device 155, and is arranged in the region of an opening 113 in the base 110. The stand device deployment mechanism is not shown in FIG. 3 for simplicity. A linkage, not shown in FIG. 3, connects the stand device deployment mechanism to stand rods 156, which are part of the stand device 155 The stand device deployment mechanism 130 is adapted to contact a ground surface when the golf bag carrier is to be arranged in a stationary position. That is, the golf bag is pivoted so that the stand device deployment mechanism is compelled against the ground, thereby automatically deploying the stand device 155 and stand rods 156 as shown (FIG. 1; also see dashed lines in FIGS. 6 and 7). Essentially, an edge of the base, or the lower base wall (sometimes called a "skirt" herein) extending from the base, with the stand device deployment mechanism, may also contact the ground as the stand device rods 156 are deployed through the linkage, contacting the ground as well, and the bag leans onto the rods.

That is, the stand device deployment mechanism 130 may comprise a kickstand-like sub-part that is connected to the stand device 155 via a linkage, to deploy or retract the rods 156. The stand device 155 and stand rods 156 are mechanically connected to the stand deployment mechanism 130 via the linkage. When the golf bag is tilted for positioning the stand device deployment mechanism against the ground, the force applied (including the weight of the bag) automatically deploys the stand device and stand rods. Releasing the pressure upon live stand device deployment mechanism 130, causes retraction of the stand rods 156 to a non-deployed position against the golf bag—the stand rods 156 are retracted back to a its non-deployed position, automatically (again, when the pressure pressing the stand mechanism 130 to the ground is released/removed). Preferably, the stand device deployment mechanism 130 does not contact the ground when the golf bag carrier is wheeled on the first and second wheels 126, and when the stand device is in a non-deployed state.

The right and left arm assemblies 122 are adapted to enable the first and second wheels 126 to be detachably removed from the golf bag carrier 110 to facilitate carry and storage. The first and second wheels include first and second axles 128, respectively. FIG. 3 includes a virtual line WL extending between the left and right wheels 126, colinear and aligned with both axles, 128. Virtual line WL is substantially parallel with a virtual line BL The right and left arm assemblies 122 include wheel-attachment mechanisms for grasping and holding fast the first and second axles 128, effecting attachment, and for releasing the first and second axles, effecting detachment.

Figure 4:
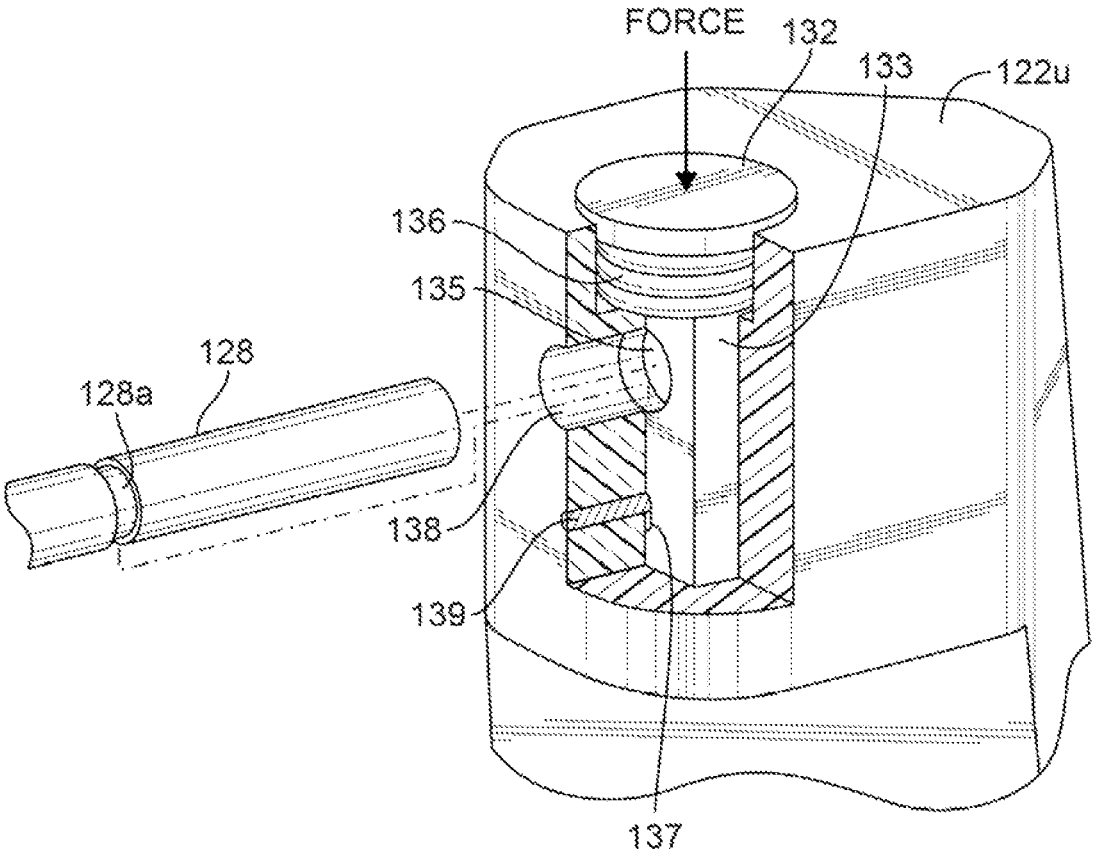
FIG. 4 is an exploded view of a mechanism adapted to attach and detach wheel axles, and wheels, to an arm portions of the base of the golf bag carrier depicted in FIG. 1.
Figure 5A:
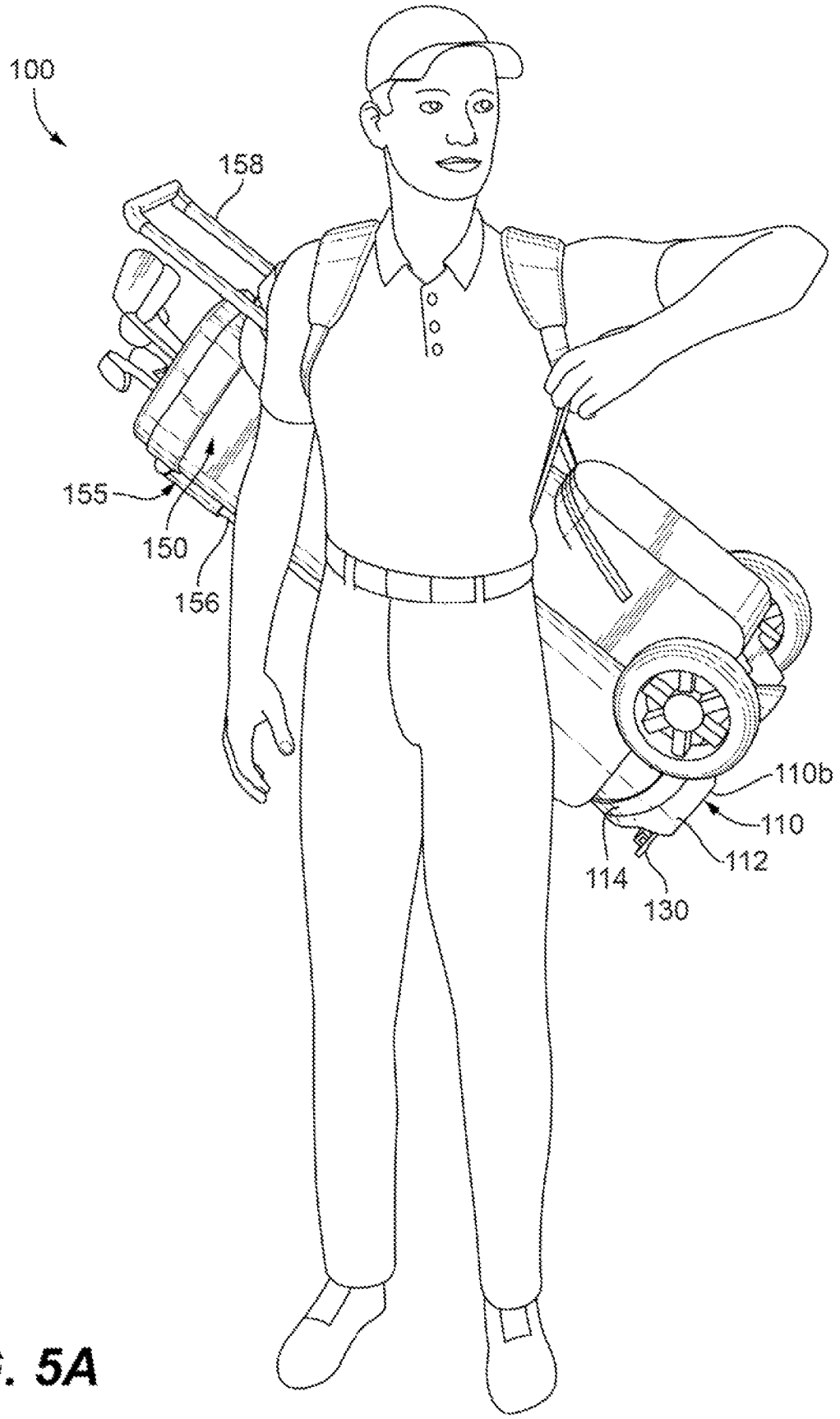
FIG. 5A is a view of the wheeled golf bag carrier, as depicted in FIG. 1, with wheels attached to the base, the golf bag carried on the shoulders of a user.
Figure 5B:
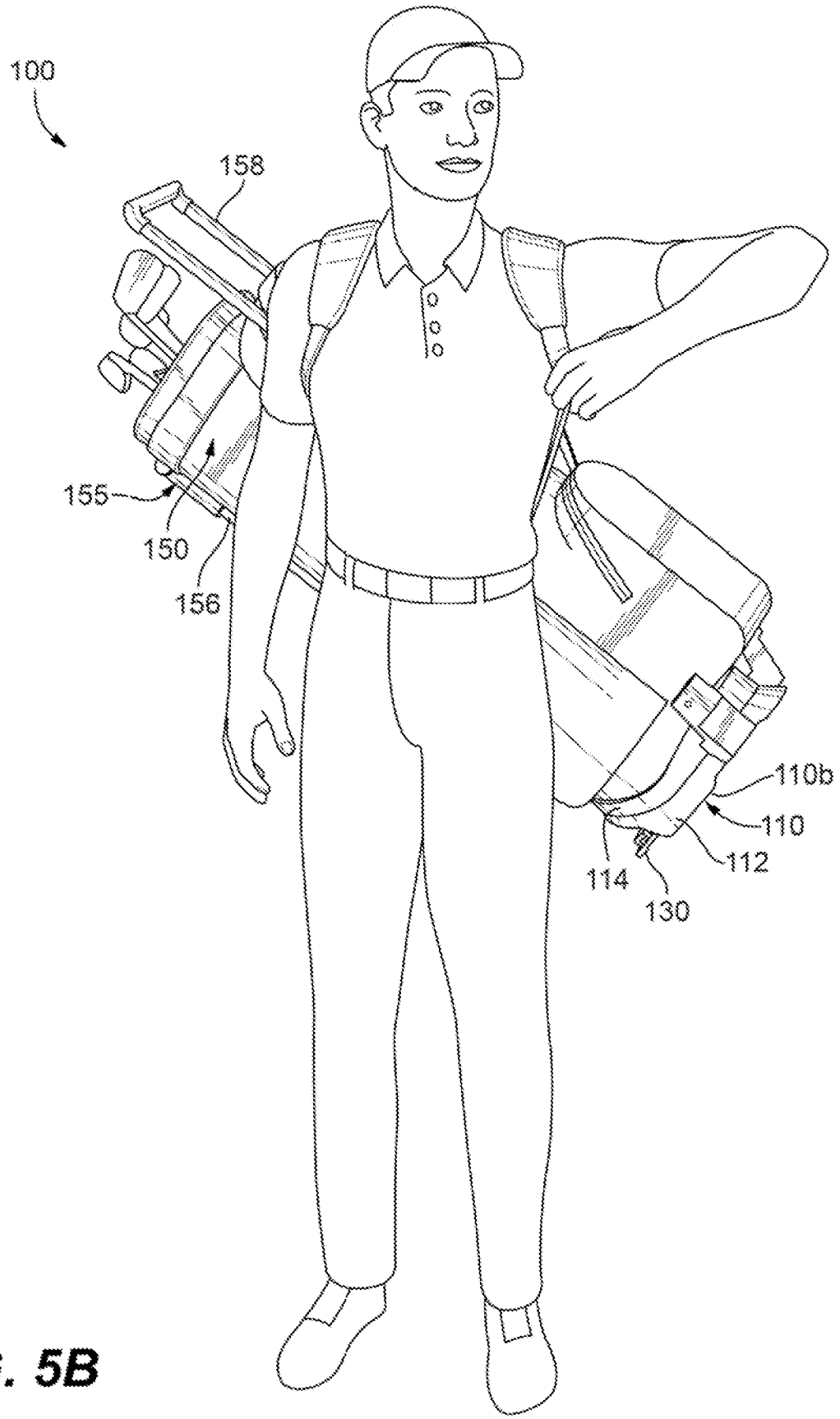
FIG. 5B shows the golf bag in FIG. 5A being carried with the wheels detached from the base.

A representative wheel-attachment mechanism is depicted in FIG. 4. Each arm assembly 122 includes an upper substantially horizontal arm section 122*u*. The upper substantially horizontal arm section 122*u* extends from a substantially vertical section, which extends from a lower substantially horizontal arm section (the lower and vertical not shown in FIG. 4), in the embodiment depicted. The lower substantially horizontal arm section is directly attached to or integral with a side wall of the base, and/or wall 112 and/or wall 114.

the base. Essentially, the upper substantially horizontal arm section 122*u* extends substantially horizontally away from the outer perimeter wall sections 112/114 of the base. Preferably, the lower horizontal arm section extends from a portion of the base perimeter closest to the bottom end, and therefore, the ground surface. Then, depending on a diameter of the wheels 126 connected at the upper horizontal arm section, and the position of the opening 135 in the connection mechanism, the higher moment of inertia and lowest center of gravity and optimal stability is realized when moving and stationary.

The wheel attachment mechanism 122, as shown embedded in the upper horizontal arm mechanism 122*u*, includes an actuator button 132, integral with a plate or bar pan 133, which actuator button 132 is depressed by application of FORCE in the arrow direction as shown, against a spring force opposing such depression, from spring 136. The bar or plate 133 includes an opening 135, when the button 132 is depressed, and an oblong opening 137 and limiting peg 139 (as shown). The oblong opening 137 receives the peg 139 to limit vertical travel of the bar or plate 133. The plate or bar 133 wants to be biased up by the spring 136, as does the button. When the plate or bar 133 is down, as shown, the opening 135 is fully open for receiving or retracting a wheel axle 128. (as limited by an extent of the oblong opening 137). A groove 128*a* of the wheel axle 128, upon release of pressure on the button 132, is captured as the opening 135 move back up with the plate or bar part 133. Depressing the actuation button 132 compresses the spring 136, moving the bar or plate 133 in the direction of the arrow, opening the opening 135 substantially fully out of the groove 128*a*, freeing the axle to be retracted from its fixed position by a lower edge of the opening. Of course, in this same position of the plate or bar 133 as shown in FIG. 3 allows an axle 128 to be inserted into the opening 135, and gripped at groove 128*a* once the pressure on the button to keep the bar or plate down, is released; this pushing up of edge part of bar or plate, defining the outer perimeter of the opening, is maintained in the groove to maintain attachment.

Preferably, the inventive golf bag carrier 100, and base 110 are adapted to pivot upon the wheels 126, about an axis extending between the first and second wheels in a connected state, as represented by virtual line WL (see FIG. 3). The pivoting causes a transition between two states. In a first pivot state, the stand device deployment mechanism 130 is compressed against the ground, compelling the stand device 155 to deploy. Doing so also compresses an edge of the base 110, or a portion of a lower wall 112, against the stand device deployment mechanism 130 and the ground. As deployed, the stand rods 156 of the stand device 155 are deployed, where the distal ends contact the ground against a weight of the bag in its slightly tilted state. FIG. 1 depicts an embodiment of the inventive golf bag carrier with the stand device deployment mechanism 130 contacting the ground. In a second pivot state, the pressure against the stand deployment mechanism is removed/released, as the bag is tilted back up (from its position depicted in FIG. 1), whereby the stand device 155 and stand rods 156 are retracted due to the stand device 135 and stand device deployment mechanism 130, and mechanical linkage connection therebetween, as known to the person skilled in the art.

FIG. 1 not only shows the first and second stand rods 156 of stand device 155 in the deployed state, with the golf bag 150 leaning into the rod distal end, but also show's that wheels 126 are off the ground. And as mentioned above, the golf bag carrier (at an edge of base 110, or of lower portion 112) and the stand deployment mechanism 130 then contact the ground, as do the lower or distal ends of the stand rods 156. This construction provides a very stable arrangement, for example, when the inventive golf bag carrier is positioned at or near a green. The first and second stand rods 156 of the stand device 155 are deployed from an undeployed storage state at a side or outside region of the golf bag, to a deployed state.

Figure 3A:
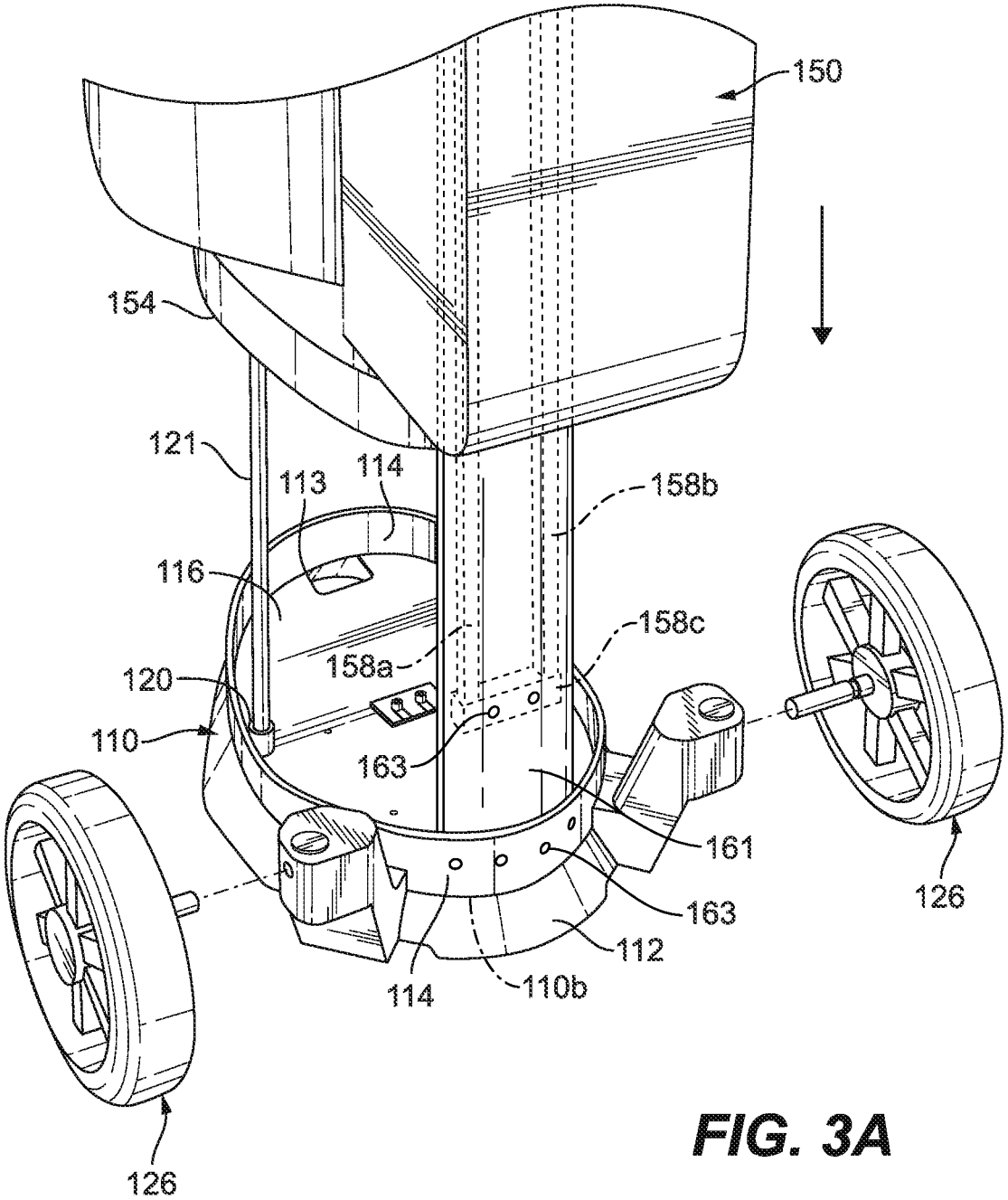
FIG. 3A is an exploded view of the wheeled golf bag carrier highlighting that the telescopic deployable handle is attached to the base for deployment from the golf bag.

FIGS. 6 and 7 depict a user pulling and pushing the inventive golf bag carrier 100, in a tilted state whereby the stand device deployment mechanism 130 and stand device 155 and stand rods 156 are non-deployed. Only the wheels 126 touch the ground. As also seen in FIGS. 6 and 7, the handle 158 preferably is deployed from a compartment 160 formed upon an outer portion of the bag 110. Golf clubs 162 are stored for use in the inner volume of the golf bag 150, via an opening 152. The telescopic handle is attached to the golf bag on the side region of the bag and contained in the pocket 160. A light weight poly carbonate board 161 or any suitable material can be attached to the bag allowing connection to mount the telescopic handle to the bag. Most preferably, the attached handle 158 is a telescopic handle. As shown in FIG. 3A, the polycarbonate board is attached to an upper, outer perimeter wall section 114 of the base 110 with rivets 163. Left handle portion 158*a* and right handle portion 158*b* are attached to a bracket 158*c*, where the bracket 158*c* is attached to the polycarbonate board 161 with rivets 163.

Preferably, the golf bag 150 includes rods or stays 159 that are received in the base 100, for example, in receptacles 120. Two receptacles 120 are shown in FIG. 3 positioned near the base perimeter at opposing positions separated by line BL, but the invention is not limited thereto. There may be many receptacles, and rods/stays 159 positioned around the base perimeter (see FIG. 3). The rods or stays 159 extend up from the receptacles 120, wherever the receptacles are positioned to receive them, through the golf bag perimeter structure, typically cloth or synthetic material but not limited thereto. As such, the rods or stays 159 built into the golf bag perimeter structure provide structural integrity to the tubular shape of the golf bag. An alternative embodiment, the golf bag 150 can be a tubular structure made of strong, shape saving resilient material, that maintains its tubular structural integrity without stays or rods. The golf bag 150 can be sewn, molded, glued, riveted or fastened to the base 110.

As shown in FIGS. 6 and 7, the golf bag preferably is substantially cylindrically- or rectangularly-tubular shaped. And while the FIGS. 1-7 embodiment of the inventive golf bag carrier 100 has the golf bag 150 permanently attached to the base 110, the invention is not limited thereto. The golf bag, in an alternative embodiment, may be detachably connected to the base.

Please note that the left and right wheels 126 have fixed radii; the right and left arm assemblies 122 are attached to the base 110 at a fixed position so that a distance between the ground and the fixed position of the right and left wheel assemblies is preferably less than the fixed radii, to affect the lower center of gravity and higher moment of inertia. Preferably, a top size is in the range of 6"-12," preferably 8.5"-10.5" and most preferably 9.6. The wheels are in the 4"-15" range, preferably in the 9-12-inch diameter range and most preferably 10 8" inches, the axle is in the ½-30" range, preferably the 1"-12" and most preferably 3.5-4 inches. The axle can be for one wheel or multiple wheels. The axle hub on the bag can be from 1-3 inches in the preferred embodiment.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

The invention claimed is:

1. A golf bag carrier, comprising:

a planar base with opposing upper and lower base surfaces and a base wall extending substantially vertically up from an outer perimeter of the planar base, and right and left arm assemblies attached to or extending out from the base wall at the outer perimeter of the planar base;

a golf bag with an open top end, and a bottom end arranged opposite the top end that is attached to or integral with the base;

first and second wheels attached to wheel axles that are detachably connectable to the right and left arm assemblies, respectively, the first and second wheels having fixed radii extending from a central axis of the wheel axles; and a stand device comprising stand rods, a linkage and a stand device deployment mechanism, the stand rods physically connected to the stand device deployment mechanism via the linkage;

wherein the base is virtually separated into two substantially equally sized opposing first and second base portions;

wherein the right and left arm assemblies are arranged in the first opposing base portion;

wherein the stand device deployment mechanism is arranged in the second opposing base portion, substantially opposite the arm assemblies, and adapted to contact a ground surface and thereby compel, through the linkage, the stand rods to be deployed when a sufficient pressure is asserted against the stand device deployment mechanism, by titling the bag thereagainst, until the stand device deployment mechanism, and an edge or lower wall part of the base contact the around, or press the stand device deployment mechanism against the ground and, when the tilting pressure applied against the stand device deployment mechanism is released, the stand rods retract to a non-deployed state;

wherein the right and left arm assemblies are attached to the base wall at fixed positions by which a distance between the ground and the fixed positions is less than a distance from the ground and the central axis of the wheel axles substantially equivalent to the fixed radii to maintain a low center of gravity and are adapted to enable the first and second wheels to be detachably removed to facilitate carrying and storage.

2. The golf bag carrier of claim 1, wherein the right and left arm assemblies include connection mechanisms for grasping and holding fast the first and second axles, effecting attachment, and for releasing the first and second axles, effecting detachment.

3. The golf bag carrier of claim 2, wherein the base is adapted to pivot about an axis extending between the first and second wheels in a connected state, to a state where the stand device deployment mechanism is asserted against the ground, compelling automatic deployment of the stand rods of the stand device, and to a state where the stand device deployment mechanism does not contact the ground, which causes the stand rods to automatically retract to a non-deployed state.

4. The golf bag carrier of claim 1, wherein the golf bag includes an attached handle adapted to be deployed to enable a user to grasp the handle and push and pull the golf bag carrier.

5. The golf bag carrier of claim 4, wherein the deployable handle is attached to the base and deployed from the golf bag.

6. The golf bag carrier of claim 4, wherein the attached deployable handle is a telescopic handle.

7. The golf bag carrier of claim 4, further comprising rods or stays extending up from the upper base surface, through the golf bag, to support a structural integrity of the golf bag.

8. The golf bag carrier of claim 1, whereas the planar base with opposing upper and lower base surfaces, and right and left arm assemblies attached to or extending from an outer perimeter of the planar base at the fixed position so that a distance between the ground and the fixed position of the right and left wheel assemblies is less than the fixed radii, which create a low center of gravity and higher moment of inertia, than if the distance between the ground and the fixed position of the right and left wheel assemblies were not less than the fixed radii, thereby providing stability to the golf bag carrier.

9. The golf bag carrier of claim 1, wherein the golf bag is substantially cylindrical-, or rectangular-tubular shaped.

10. The golf bag carrier of claim 1, wherein the golf bag is detachably connected to the base.

11. The golf bag carrier of claim 1, wherein the golf bag is sewn, molded, glued, riveted or fastened to the base.

12. The golf bag carrier of claim 1, wherein the left and right arm assemblies are adapted to extend beyond an outermost portion of the planar base.

13. A golf bag carrier, comprising:

a planar base with opposing upper and lower base surfaces and a perimeter base wall extending substantially vertically up from the upper base surface at an outer perimeter of the planar base;

right and left arm assemblies attached to or extending from the base wall;

a lightweight golf bag attached to the planar base;

first and second wheels with wheel axles, where the wheels are detachably connectable by the wheel axles to the right and left arm assemblies, respectively;

wherein the planar base comprises substantially equally sized opposing first and second base portions;

wherein the first base portion includes the right and left arm assemblies, which right and left arm assemblies extend outward, away from the outer base wall;

wherein the right and left arm assemblies are attached to the base wall at fixed positions by which a distance between the ground and the fixed positions is less than a distance from the ground and a central axis of the wheel axles that is substantially equivalent to the fixed radii, realizing a base with a high moment of inertia such that the golf bag and base resist tilting, tipping or twisting; and wherein the golf bag portion is lightweight due to a golf bag construction of lightweight, high strength materials.

14. A method of using a golf bag carrier comprising a planar base, right and left arm assemblies attached to or extending from an outer perimeter wall of the planar base, a golf bag with an open top end and a bottom end arranged opposite the top end that is attached to or integral with the base, first and second wheels detachably connectable to the right and left arm assemblies, respectively and a stand comprising stand rods, a linkage and a stand device deployment mechanism, the stand rods physically connected to the stand device deployment mechanism via the linkage, and the stand device deployment mechanism adapted to contact the ground through an opening in the planar base, the method comprising the steps of:

tilting the golf bag to compress the stand device deployment mechanism against the ground, which automatically, through the linkage, deploys the stand rods of the stand device; and adjusting the stand rods against the ground to create a stable three-point contact of distal ends of the stand rods and the stand device deployment mechanism against the ground.

15. The method of claim 14, further including tilting the golf bag to release pressure compelling the stand device deployment mechanism against the ground, which automatically retracts the stand rods to a non-deployed state, allowing the bag to be wheeled.

16. The method of claim 14, further including depressing a release mechanism in the arm assemblies to detach the wheels.

17. The method of claim 16, further including depressing the release mechanism to enable attachment of the wheels and inserting wheels axles into the arm assemblies.

18. The method of claim 16, further including carrying or storing the golf bag carrier with the wheels detached.

19. The golf bag carrier of claim 14, further including carrying the golf bag with the wheels attached.

* * * * *